United States Patent [19]

Gunderson et al.

[11] Patent Number: 4,630,970

[45] Date of Patent: Dec. 23, 1986

[54] BUOYANCY SYSTEM FOR SUBMERGED STRUCTURAL MEMBER

[75] Inventors: Richard H. Gunderson; Terry N. Gardner, both of Houston, Tex.; Peter J. D. Guile, Berkshire, England

[73] Assignee: Exxon Production Research Co., Houston, Tex.

[21] Appl. No.: 775,913

[22] Filed: Sep. 13, 1985

[51] Int. Cl.[4] ..... E02B 17/00; B63B 35/44

[52] U.S. Cl. ..... 405/224; 166/350; 175/7; 405/195; 114/265

[58] Field of Search ..... 405/195–199, 405/202–208, 224–227; 166/350, 359, 367; 175/7; 114/264, 265

[56] References Cited

U.S. PATENT DOCUMENTS

| | | | |
|---|---|---|---|
| 3,017,934 | 1/1962 | Rhodes | 166/350 |
| 3,517,517 | 6/1970 | Blenkarn | 405/225 |
| 3,858,401 | 1/1975 | Watkins | 166/350 |
| 3,981,357 | 9/1976 | Walker | 166/350 |
| 4,102,142 | 7/1978 | Lee | 405/195 |
| 4,176,986 | 12/1979 | Taft | 405/195 |
| 4,285,615 | 8/1981 | Radd | 405/224 |
| 4,422,801 | 12/1983 | Hale | 405/195 |
| 4,521,135 | 6/1985 | Silcox | 405/195 X |

FOREIGN PATENT DOCUMENTS

| | | | |
|---|---|---|---|
| 2142285A | 1/1985 | United Kingdom | 405/224 |
| 2142286A | 1/1985 | United Kingdom | 405/224 |

*Primary Examiner*—Dennis L. Taylor

*Attorney, Agent, or Firm*—Richard F. Phillips

[57] ABSTRACT

A buoyancy system for a tension leg platform tether 10 or other element extending a significant vertical distance through a body of water. A series of bulkheads 25 divide the interior of the tether 10 into individual buoyancy cells 31. A central access tube 32 extends along the central axis of the tether 10, passing through a sealed penetration in each bulkhead 25. A series of cascade conduits 42 are provided the lower portion of each buoyancy cell 31 in fluid communication with the buoyancy cell 31 immediately above. A tool 82 is provided for injecting air into a selected buoyancy cell 31. As air is injected, water exists through the central access tube 32 until the buoyancy cell 32 is emptied of water, at which point air passes through the cascade conduit 42 into the adjacent upper buoyancy cell. The tool 82 can also be used to selectively flood individual buoyancy cells 31.

30 Claims, 13 Drawing Figures

BUOYANCY SYSTEM FOR SUBMERGED STRUCTURAL MEMBER

TECHNICAL FIELD

The present invention generally concerns a buoyancy system for submerged elements exposed to differing external pressures along their length. More specifically, the present invention concerns a tension leg platform tether having a cascade air buoyancy system.

BACKGROUND OF THE INVENTION

Tension leg platforms are a type of marine structure having a buoyant main body secured to a foundation on the ocean floor by a set of tethers. A typical tension leg platform is shown in FIG. 7 of the appended drawings. The point of connection between the buoyant main body and each tether is selected so that the main body is maintained at a significantly greater draft than it would assume if free floating. The resulting buoyant force of the main body exerts an upward load on the tethers, maintaining them in tension. The tensioned tethers substantially restrain the tension leg platform from pitch, roll and heave motions induced by waves, current and wind. Surge, sway and yaw motion are substantially unrestrained, and in these motions a tension leg platform behaves much like a conventional semisubmersible platform. It is important that the installation tension of the tethers be sufficiently great to ensure that under ordinary wave and tide conditions the tethers are not permitted to go slack.

Tension leg platforms have attracted interest for use in offshore oil and gas production operations in water depths exceeding about 250 meters (820 feet). As water depths exceed 200–350 meters (656–1184 feet), depending on the severity of the environment, the structure required to support the deck of a jacket or other conventional bottom founded platform becomes quite expensive. Unlike conventional offshore platforms, tension leg platforms are not designed to resist horizontal environmental forces. Instead, tension leg platforms comply with horizontal forces and thus largely avoid the depth sensitivities inherent to conventional structures. It has been suggested that tension leg platforms could be employed in depths up to 3000 meters (9840 feet), whereas the deepest present application of a conventional offshore jacket is in a water depth of approximately 412 meters (1350 feet).

Though tension leg platforms avoid many problems faced by conventional platforms, they are subject to their own special difficulties. The most significant of these concerns buoyancy requirements. The main body of a tension leg platform must be sized to provide sufficient buoyancy to support not only its own weight, but also the weight of the equipment and crew facilities necessary to oil and gas drilling and producing operations. The main body must also support the active load imposed by the tensioned tethers. It is highly desirable to provide the tethers with buoyancy sufficient to offset some or all of their weight. This decreases the ineffective component of the load imposed on the main body by the tensioned tethers, eliminating the need to provide the main body with an additional degree of buoyancy sufficient to support the weight of the tethers. The decreased main body buoyancy requirements decrease the size and cost of the tension leg platform.

United Kingdom patent application No. 2,142,285A, having a priority filing date of June 28, 1983, teaches a tether design in which the tether is provided with significant inherent buoyancy. This application discloses the use of tubular tethers filled with gas pressurized to a level above the hydrostatic pressure of the surrounding seawater encountered at the lowest point in the tether. A system is provided for monitoring the gas pressure of the tether to detect any leaks that may occur. This design imposes a differential pressure across the wall of the tether which, near the ocean surface, will exceed the hydrostatic seawater pressure at the ocean floor. For an installation depth of 600 meters (1970 feet) this corresponds to a differential pressure of 6.1 megapascals (890 psi). The tether walls must be designed to withstand this high differential pressure. Also, the joints securing the individual sections of the tether together must include seals sufficient to prevent gas leakage across the great pressure differential. Further, because the tether interior forms a single, continuous channel, the entire tether could flood if a leak developed of sufficient size that air escaped more quickly than it could be replaced by the tether gas pressurization system.

As an alternative to an internal buoyancy system, buoyancy modules can be secured to the outside of submerged members. A riser buoyancy system of this type is shown in U.S. Pat. No. 4,422,801, issued on Dec. 27, 1983. This riser buoyancy system includes a number of individual air cans secured to the outer wall of the riser. Such systems would be disadvantageous for use with tethers in that they make inspection of the outer surface of the tether for cracks and corrosion quite difficult. Also, external buoyancy systems increase the effective diameter of the tether relative to tethers having internal buoyancy systems, increasing the forces imposed on the tether by ocean currents and waves.

It would be advantageous to provide a tether buoyancy system which avoids significant pressure differentials across the wall of the tether; which maintains the outer surface of the tether free from buoyancy modules; which is controllably ballastable and deballastable to aid in tether installation and removal; which avoids the need for seals in the joints joining the individual sections of the tether; which does not flood completely in the event of a leak through a tether wall; which can be deballasted continuously as individual sections are being joined in the course of tether installation; which provides an immediate and highly reliable indication of a leak anywhere in the tether; and, which accommodates a simple and reliable method for determining the location of any leak in the tether.

SUMMARY OF THE INVENTION

A buoyancy system is set forth which is especially well suited for use in the tethers of a tension leg platform. Each tether is tubular and is divided by bulkheads into a series of buoyancy cells. Preferably, the tether is composed of a series of threadably or weldably connectable tubular tether sections each having a bulkhead at its uppermost end, each tether section serving as a buoyancy cell. A central access tube extends the length of each tether section and penetrates the bulkhead at its upper end aligning with the central access tube of the tether section immediately above. A cascade conduit places the lower portion of each buoyancy cell in fluid communication with the buoyancy cell immediately above it. Means are provided for injecting gas into a selected one of the buoyancy cells. As gas is injected into a buoyancy cell, the gas displaces the ballast liquid in the buoyancy cell until the gas level reaches the lower end of the cascade conduit, allowing gas to cascade into the next buoyancy cell above. The displaced ballast liquid is forced into the central access tube and cascade conduit and exits to a reservoir proximate the top of the tether. Gas injection continues until all buoyancy cells are filled with gas. The pressure of the gas and ballast liquid within each buoyancy cell is maintained substantially equal to the seawater immediately outside the buoyancy cell by maintaining the central access tube full of ballast liquid to the top of the tether.

BRIEF DESCRIPTION OF THE DRAWINGS

For a better understanding of the present invention, reference may be made to the accompanying drawings, in which.

These drawings are not intended as a definition of the invention, but are provided solely for the purpose of illustrating certain preferred embodiments of the invention, as described below.

DESCRIPTION OF THE PREFERRED EMBODIMENTS

Figure 1:
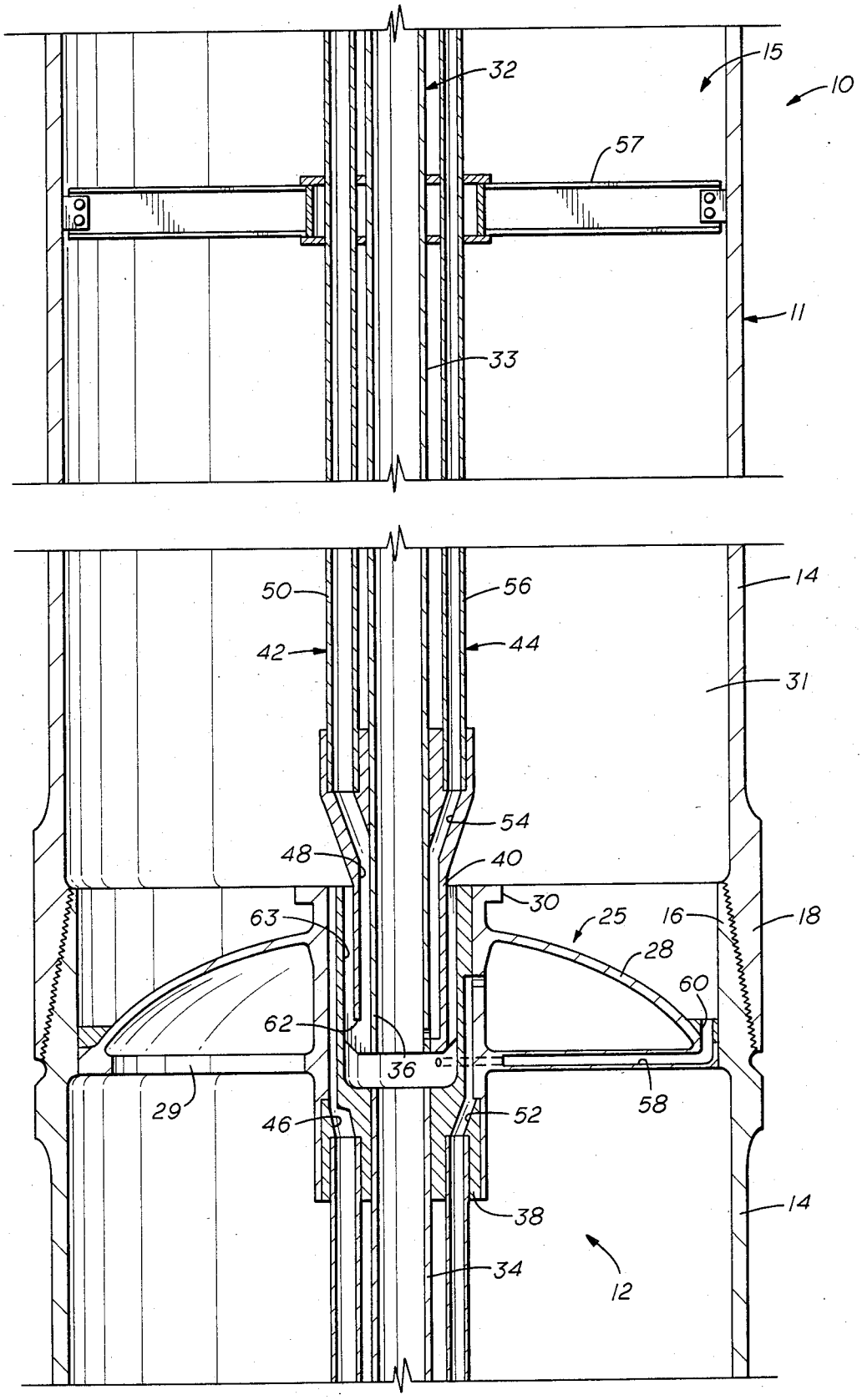
FIG. 1 shows an elevational cross section of a tension leg platform tether buoyancy system incorporating a preferred embodiment of the present invention.
Figure 2:
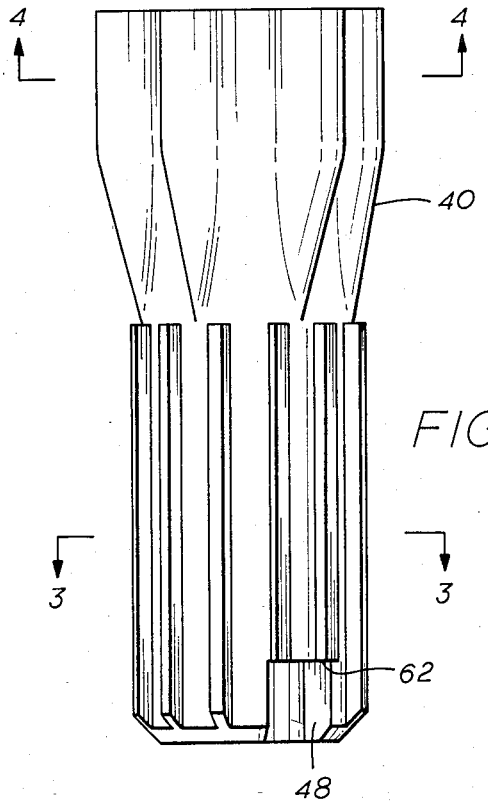
FIG. 2 shows an elevational view of the central access tube pin of the tether buoyancy system shown in FIG. 1.
Figure 5:
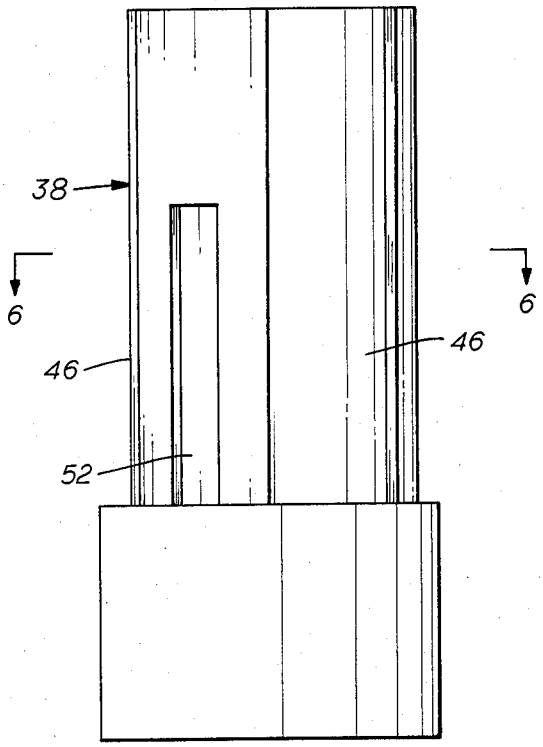
FIG. 5 shows an elevational view of the central access tube box of the tether buoyancy system shown in FIG. 1.
Figure 3:
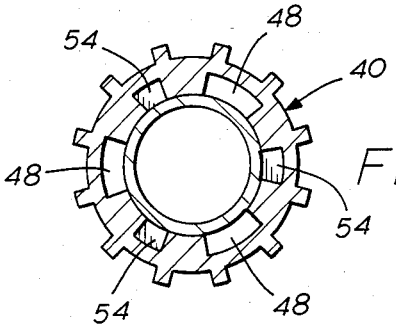
FIG. 3 shows a sectional view of the central access tube pin taken along section line 3—3 of FIG. 2.
Figure 6:
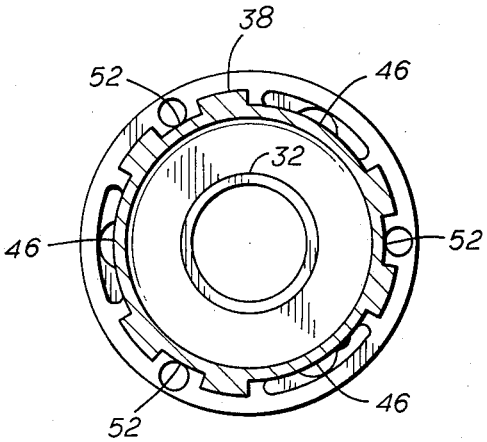
FIG. 6 shows a sectional view of the central access tube pin taken along section line 6—6 of FIG. 5.

Illustrated in FIG. 1 is a portion of a tension leg platform tether 10 incorporating a preferred embodiment of the buoyancy system 12 of the present invention. As will become apparent in view of the subsequent discussion, the buoyancy system 12 is especially well suited for decreasing or eliminating the ineffective component (that is, the weight component) of the load imposed by the tethers on the buoyant main body of a tension leg platform ("TLP"). However, the present invention is also useful in other applications in which it is desirable to provide buoyancy to submerged elongate structural members. To the extent that the embodiment described below is specific to tension leg platform tethers, this is by way of illustration rather than limitation.

Figure 7:
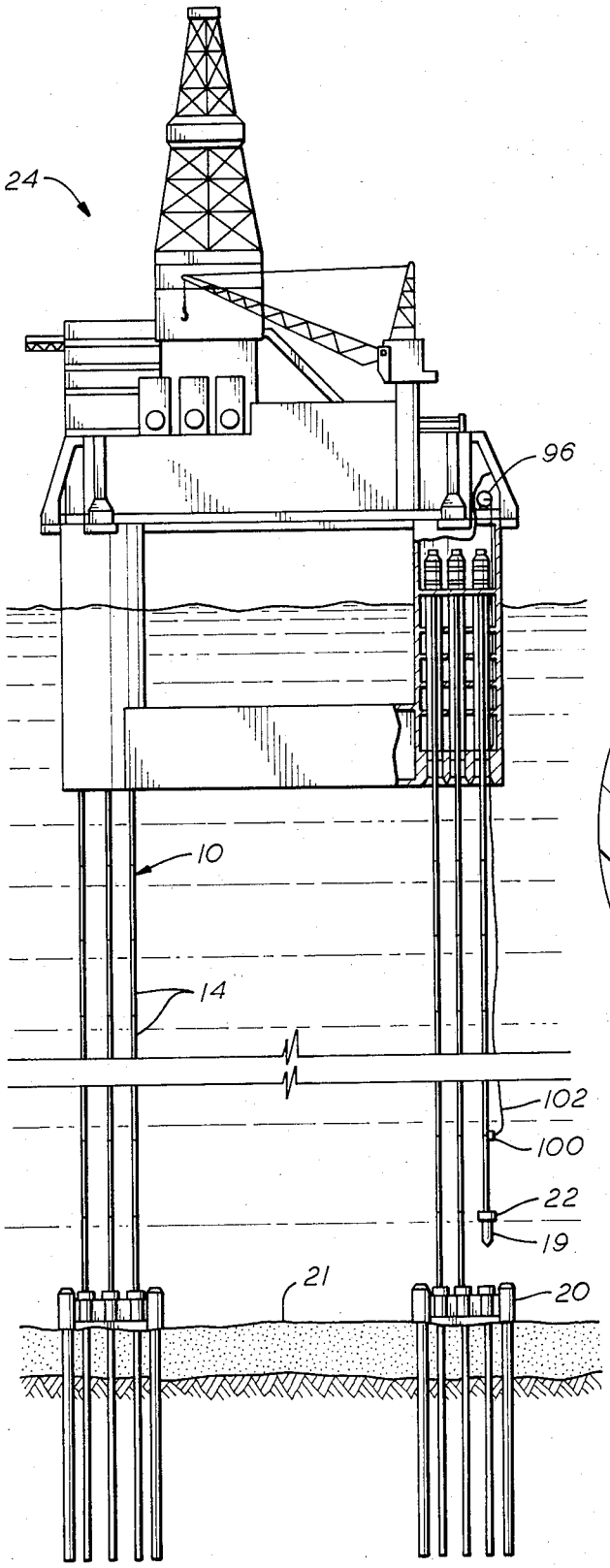
FIG. 7 shows an elevational view of a tension leg platform incorporating the buoyant tethers of the present invention.
Figure 11:
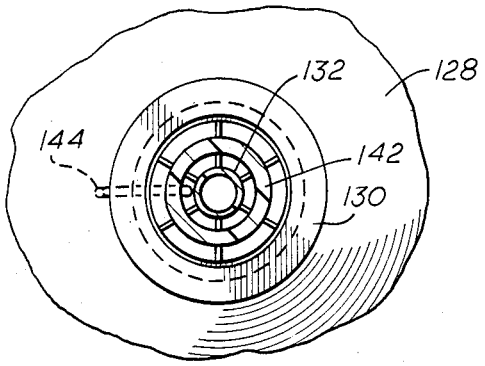
FIG. 11 is a cross sectional view taken through section line 11—11 of FIG. 10.
Figure 12:
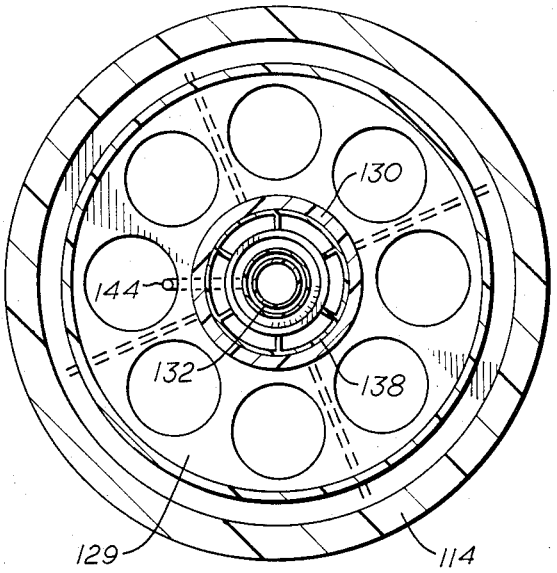
FIG. 12 is a cross sectional view taken through section line 12—12 of FIG. 10.
Figure 13:
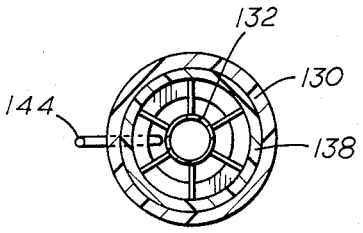
FIG. 13 is a cross sectional view taken through section line 13—13 of FIG. 10.

As illustrated in FIGS. 1 and 7, the tether 10 has an elongate load bearing wall portion 11 composed of a plurality of tubular sections 14. The wall portion 11 defines a central channel 15 extending the length of the tether 10. Each tether section 14 is provided with a threaded pin 16 at its upper end and a threaded box 18 at its lower end so that the tether sections 14 may be joined one to the other. Though threaded couplings are use in the preferred embodiment for joining the individual tether sections 14, those skilled in the art will recognize that other types of couplings could be substituted. When joined together the tether sections 14 establish a single elongate tubular tether 10. All but one of the tether sections 14 are of a uniform length, preferably 10–50 meters (33–164 feet), with the uppermost tether section 14 having a greater or lesser length as necessary to make the complete tether 10 the exact length required for the application. As shown in FIG. 7, a base latch 19 is secured beneath the lowermost tether section 14 for locking the tether 10 to a foundation 20 on the ocean floor 21. The base latch 19 is provided with a flexjoint 22 to permit the tether 10 to pivot about the foundation 20 to accommodate limited lateral motion of the TLP 24 in response to wind, waves and ocean currents.

The upper end of each tether section 14 is provided with a bulkhead 25. Alternately, the bulkhead 25 could be positioned at the lower end of each tether section 14; however, as will be appreciated in view of the subsequent discussion, this would introduce complications in maintaining pressure integrity of the central access tube. Each bulkhead 25 includes a pressure dome 28, a perforated support disc 29, and a central flanged tube 30 concentric with the tether section 14. The upper portion of the central flanged tube 30 serves as an elevator shoulder for lifting the individual tether section 14. Each bulkhead 25 divides the interior of the corresponding tether section 14 into an upper volume above the bulkhead and a lower volume below the bulkhead. When the individual tether sections 14 are joined together to form the tether 10, the bulkheads 25 divide the central channel 15 of the tether 10 into a series of compartments extending along the length of the tether 10, each serving as an individual buoyancy cell 31. As further detailed below, each buoyancy cell 31 is filled with gas. The tether wall thickness to diameter ratio is established to provide the tether 10 with the desired degree of buoyancy.

A central access tube 32 extends along the longitudinal axis of the tether 10. Like the tether 10, the central access tube 32 is made up of a number of individual sections 33, each secured within a corresponding one of the tether sections 14. Each access tube section 33 has opposed first and second ends 34, 36 provided, respectively, with a box element 38 and a pin element 40. The box element 38 is secured within the central flanged tube 30 of the bulkhead 25. The access tube second end 36 extends to a position substantially flush with and concentric to the tether section pin 16 so that as adjoining tether sections 14 are joined together the access tube pin 40 of the upper tether section 14 stabs into the access tube box 38 of the lower tether section 14. The central access tube 32 defines a channel passing through each of the bulkheads 25 and extending the full length of the tether 10. FIGS. 2–6 provide several views of the access tube pin and box elements 38, 40. The central access tube 32 provides several functions; it maintains the column of ballast liquid used to pressure balance each of the buoyancy chambers 31; it serves as a conduit for the transfer of ballast liquid between the buoyancy chambers 31 and a ballast liquid reservoir, described below, in the TLP 24; it provides a passage for a tool used to activate and deactivate the tether base latch 19; and, it permits a ballast-deballast tool, described below, to be lowered to any selected tether section 14 to inject gas or ballast liquid into the corresponding buoyancy cell 31.

Figure 4:
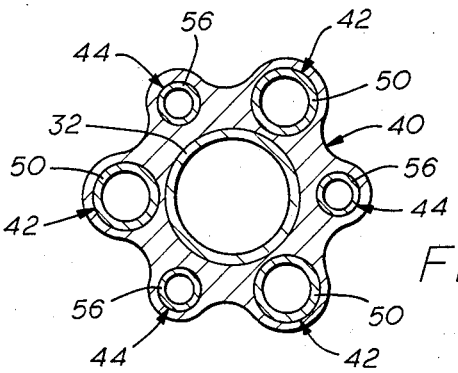
FIG. 4 shows a sectional view of the central access tube pin taken along section line 4—4 of FIG. 2.

Each tether section 14 is provided with a set of cascade conduits 42 and gas release conduits 44 used, respectively, in introducing gas into and removing gas from each tether section 14, as described below. The cascade conduits 42 are each composed of a cascade passage 46 in the access tube box 38, a cascade passage 48 in the access tube pin 40 and a cascade line 50 placing the pin and box cascade passages 46, 48 in fluid communication. Similarly, the gas release conduits 44 include a gas release passage 52 in the access tube box 38, a gas release passage 54 in the access tube pin 40 and a gas release line 56 placing the pin and box gas release passages 52, 54 in fluid communication. A series of supports 57 are provided along the length of each tether section 14 to centralize the central access tube 42, the cascade line 50 and the air release lines 56. In the preferred embodiment, three cascade conduits 42 and three air release conduits 44 are provided for each tether section 14, these being arranged in a concentric array about the central access tube 32, as best shown in FIG. 4. However, the number, size and placement of the cascade and air release conduits 42, 44 are matters of design choice, being controlled primarily by the need to obtain satisfactory gas and liquid flow rates through the tether buoyancy system 12.

As best shown in FIG. 1, the cascade conduits 42 each establish a fluid flowpath from a position proximate the lower end of the buoyancy cell 31 defined by each tether section 14 to the next buoyancy cell 31 above. A drain conduit 58 provides a fluid flowpath from a drain port 60 preferably located at the lowest point in the upper surface of the bulkhead 25 to the central access tube 32. This drain port location permits substantially all ballast liquid to be removed from each buoyancy cell 31 in the gas pressurization process. The access tube pin cascade passage 48 is configured so that the lowest portion 62 of the cascade passage 48 is at approximately the same level as the drain port 60. This relative positioning ensures that gas will not cascade from a first buoyancy cell to the buoyancy cell above until substantially all ballast liquid has been removed from the first buoyancy cell 31. After sufficient gas has been introduced into a buoyancy cell 31 to force the liquid level below the lowest portion 62 of the access tube cascade passage 48, all additional gas injected into buoyancy cell 31 will cascade through the cascade conduits 42 into the next buoyancy cell 31 above. It should be noted that the cascade conduits 42 are normally filled with ballast liquid. Gas passes through the cascade conduits 42 by bubbling through the ballast liquid therein.

The central access tube 32 is filled with water or other liquid to establish a ballast liquid column extending through each tether 10 from the main body of the TLP 24 to the tether foundation 20. As shown in FIG. 1, for each buoyancy cell 31 a fluid communication path 63 exists between the lower portion of the buoyancy cell 31 and that portion of the central access tube 32 adjacent the lower portion of the buoyancy cell 31. This fluid communication path 63 is defined by the box and pin elements 38, 40. The fluid communication path 63 causes the lower portion of each bouyancy cell 31 to be in pressure balance with the adjacent portion of the central access tube 32. Because each bouyancy cell 31 is occupied by gas, the internal pressure of each bouyancy cell 31 will remain substantially constant along its length. As further detailed below, the pressure of the ballast liquid column approximates that of the surrounding seawater. Accordingly, the greatest pressure differential acting on the walls of the tether 10 occurs at the top of each buoyancy cell 31, this differential being equal to the differential existing at the bottom of the buoyancy cell 31 plus the differential resulting from the change in the hydrostatic pressure head of seawater along the length of the buoyancy cell 31. For a tether section 14 having a length of 30 meters (98 feet), the pressure differential at the top of each bouyancy cell 31 would be approximately 400 kPa (60 psi), assuming the ballast fluid column is maintained at a pressure 100 kPa (15 psi) above that of the seawater. This pressure differential is well below that which would require any special strengthening of the walls of the tether 10. A pressure differential of 300 kPa (45 psi) acts across each bulkhead 25.

Figure 8:
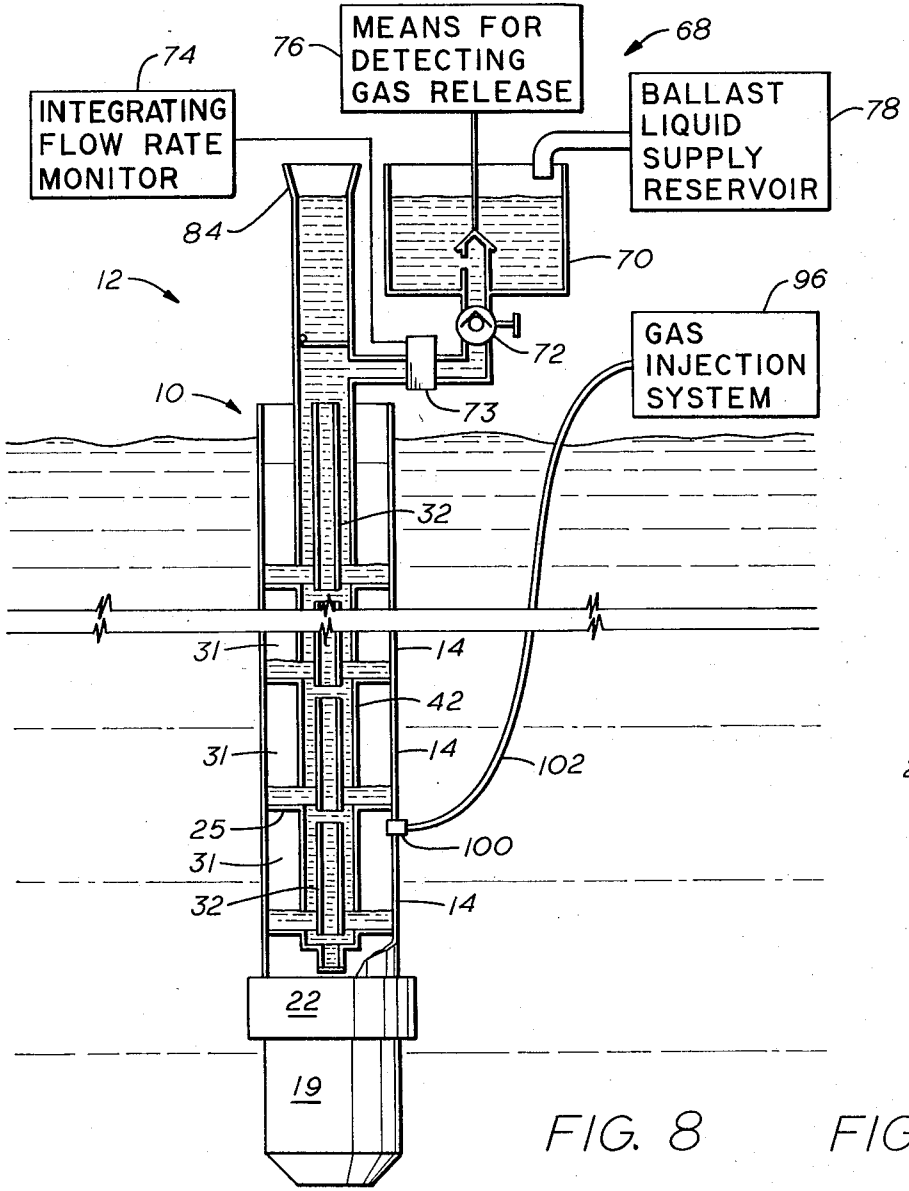
FIG. 8 shows a simplified diagrammatic view of the header tank and associated equipment for transferring ballast liquid to and from a tether, the air release conduits have been deleted for clarity.
Figure 10:
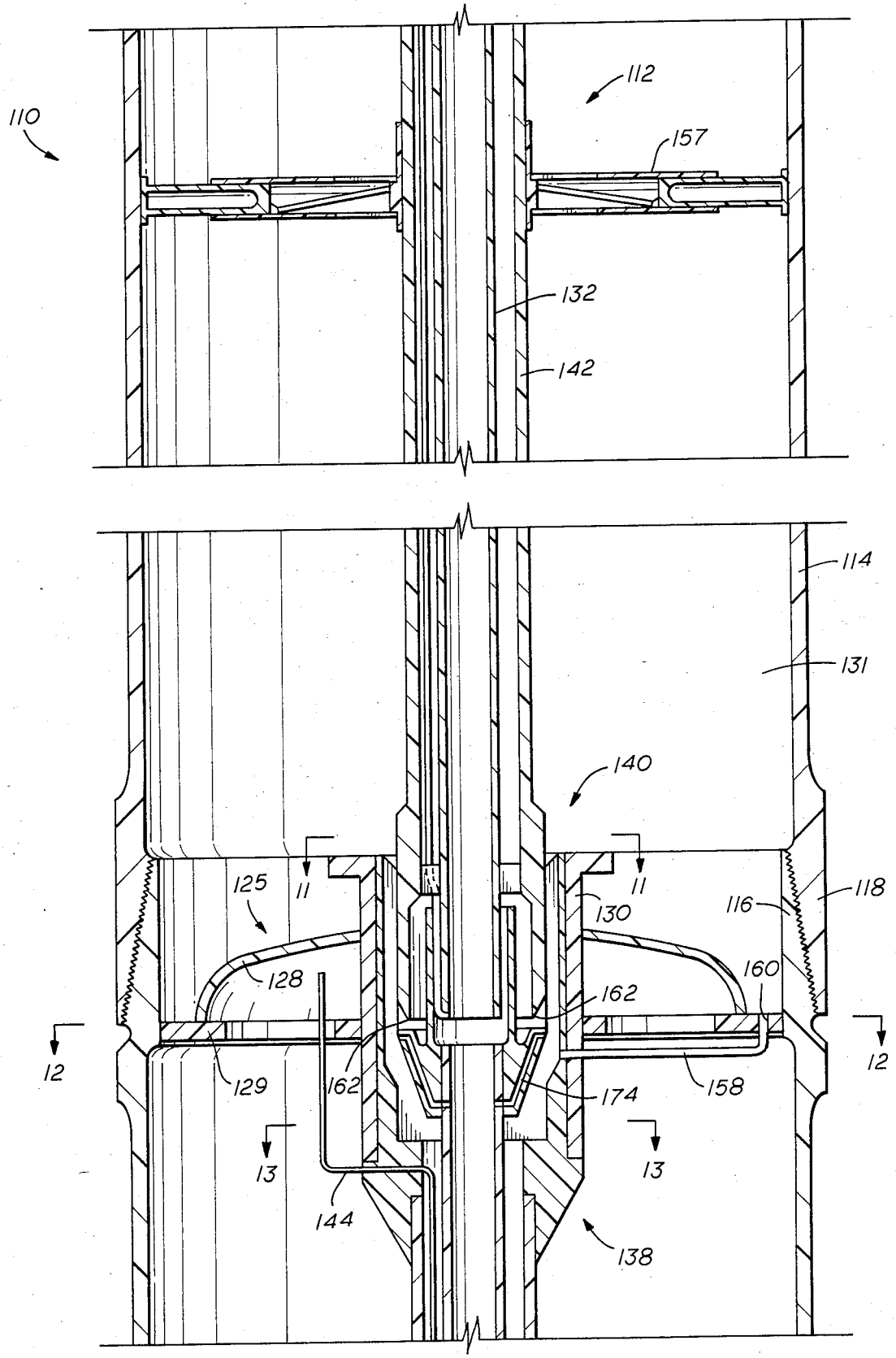
FIG. 10 shows an elevational view of alternate embodiment of the tether buoyancy system.

In the preferred embodiment, the internal pressure at the lower end of each buoyancy cell 31 is maintained a preselected amount, preferably 100–180 kPa (15–26 psi), greater than that of the surrounding seawater. This is achieved by filling the central access tube 32 with a ballast liquid having a density substantially equal to that of seawater, and maintaining the level of this liquid 10–18 meters (33–59 feet) above the level of the seawater. In the preferred embodiment this is accomplished with a header tank system 68 such as that diagrammatically illustrated in FIG. 8. A header tank 70 is situated above the upper end of the tether 10 and is in fluid communication with both the central access tube 32 and the uppermost set of cascade conduits 42. The header tank 70 serves as a reservoir for transfer of ballast liquid between the tether 10 and the TLP 24. It is especially important to ensure that the ballast liquid level does not drop as a result, for example, of gas leakage or gas consumption in the course of corrosion. The header tank 70 should have a lateral cross section which is large relative to the cross section of the access tube 32. This minimizes the liquid level drop (and, hence, pressure drop) resulting from the transfer of ballast liquid into the tether from the header tank 70. This also ensures that the resonance period of the fluid column in the access tube 32 is less than the heave resonance of the tension leg platform 24. A non-return valve 72 is situated intermediate the header tank 70 and the central access tube 32 to prevent uncontrolled return of ballast liquid from the tether 10. The non-return valve 72 may be manually opened to permit ballast liquid return in the course of air injection into the tether 10. Means 76 are provided for detecting gas release into the header tank 70 from the tether 10. This is useful for determining when gas is cascading from the uppermost tether section 14 in the course of air injection and for detecting cascade conduit leakage. A single ballast liquid supply 78 is provided to serve as a reservoir for transfer of ballast liquid to and from the header tanks 70 associated with a set of tethers 10.

The header tank system 68 is preferably provided with a flow meter 73 and integrating flow rate monitor 74 or other means for monitoring the rate and cumulative magnitude of liquid flow between the header tank 70 and the tether 10. The flow rate monitor 74 facilitates ballasting and deballasting operations for individual buoyancy cells 31 by allowing the total amount of ballast liquid entering or leaving an individual buoyancy cell 31 to be monitored. The operation may be terminated once the appropriate amount of liquid has entered or left the buoyancy cell 31. Further, the inclusion of such a monitor 74 is especially valuable for use in tether fatigue crack detection. Fatigue cracks in tethers generally propagate circumferentially and, even in the most severe circumstances, tend to develop from inception to the point where they cause tether failure over a protracted period, typically on the order of months to years. Because the tether wall is relatively thin, a fatigue crack will extend through the tether wall before it has propagated a significant distance around the circumference of the tether. This permits gas from the buoyancy cell 31 to leak from inside the tether to the surrounding seawater. This leakage is replaced by ballast liquid from the central access tube 32, which is itself replenished by the header tank 70. This leakage is detected by the fluid flow monitor 74. In this manner, fatigue cracks are detected long before they can cause tether failure, avoiding the need for hurried tether changeout. The specific location of the fatigue crack can be established with aid of an ultrasonic tool (not shown) or other instrument lowered through the central access tube 32 for determining gas-liquid interfaces. The level of ballast liquid in any buoyancy cell 31 having a fatigue crack will rise to the highest point of the fatigue crack, replacing the gas which leaks through the crack into the surrounding seawater.

Because the fluid pressure within the tether interior is greater than that of the surrounding seawater along the entire length of the tether 10, leaks will predominately result in fluids leaving rather than entering the tether interior. This ensures that seawater will largely be excluded from the tether 10, facilitating corrosion control. Additionally, because the joints at which the tether sections 14 are threaded together occur at the bottom of each buoyancy cell 31, where the differential pressure is maintained at its lowest level, it is not necessary to provide any special seals to maintain the pressure integrity of the tether 10. The threaded joint alone can support the low differential pressure. Further, because all points of fluid access between the central access tube 32, the cascade conduits 42 and each buoyancy cell 31 occur at the lowermost portion of each buoyancy cell 31, where the gas and ballast liquid are in pressure equilibrium, the tether buoyancy system 12 does not require any internal seals.

Figure 9:
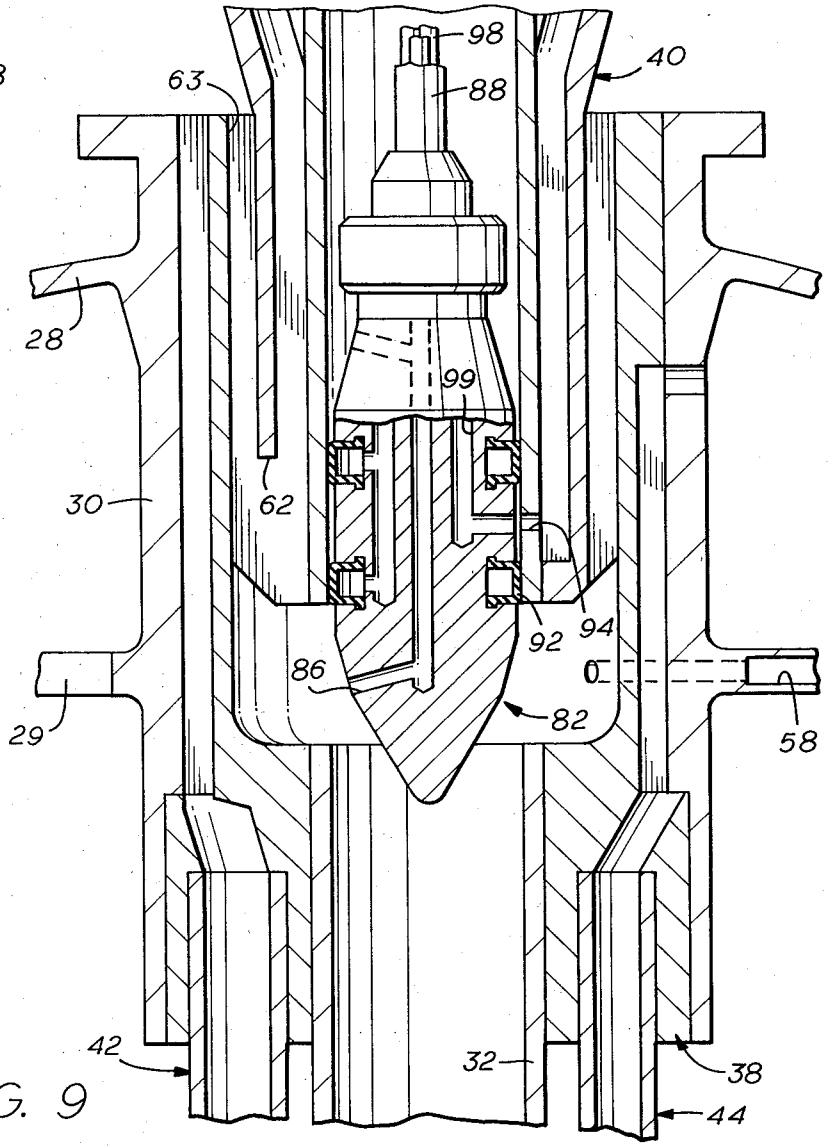
FIG. 9 shows an elevational cross section of the air injection tool.

A ballast-deballast tool 82, illustrated in FIG. 9, is used to inject gas or ballast liquid into a selected one of the buoyancy cells 31. The ballast-deballast tool 82 is lowered through the central access tube 32 from a tool entry port 84 (FIG. 8) at the upper end of the tether 10 to the lower boundary of the buoyancy cell 31 into which gas is to be injected. The tool 82 is weighted and provided with a fluid flow passage 86 between its upper and lower ends to facilitate its passage downward through the central access tube 32. An umbilical 88 extends between the tool 82 and a control station located on the deck of the tension leg platform 24. Means are provided to monitor the position of the tool 82. In the preferred embodiment, the monitoring means is a caliper which detects the gap between individual sections of the central access tube 32. The ballast-deballast tool 82 can be provided with an ultrasonic transducer or other means for establishing the gas-liquid interface in each buoyancy cell 31. This facilitates locating individual buoyancy cells 31 which are partially flooded with ballast liquid.

To fill a flooded buoyancy cell 31 with gas, the tool 82 is lowered to the lower end of the access tube 32 corresponding to the buoyancy cell 31 to be filled and packers 92 are activated to isolate the gas passage ports 94. Gas is then injected into the buoyancy cell 31 from a gas injection system 96 on the deck of the tension leg platform 24. The injected gas passes through a conduit 98 in the umbilical 88, though a channel 99 in the tool 82 and then into the space defined by the packers 92. Liquid in the buoyancy cell 31 is expelled through the drain conduit 58 and returns upward through the central access conduit 32 via the fluid flow passage 86 in the ballast-deballast tool 64. Continued injection of gas after the buoyancy cell 31 is emptied of liquid will cause excess gas to cascade into the buoyancy cells 31 above, emptying them if they are flooded.

Selective flooding of one of more buoyancy cells 31 is accomplished in a manner similar to gas injection. Flooding several of the lowest buoyancy cells 31 may be desirable prior to the removal of the tether 10 for maintenance or replacement. The added weight resulting from this flooding maintains the tether 10 in tension as it is lifted to the surface. This prevents excessive lateral motion and bending stresses in response to the forces imposed by ocean currents and waves. Buoyancy cell flooding is accomplished by packing off around the air passage ports 94 and then decreasing the pressure in the umbilical fluid conduit 96. In response to the decreased pressure, gas will flow from the buoyancy cell 31 through the gas release conduits 44 and upward to the surface through the umbilical fluid conduit 96. This gas is replaced by ballast liquid entering the buoyancy cell 31 through the access tube cascade passage 48 and the drain conduit 58. Ballast liquid flows from the header tank 70 into the central access tube 32 during this process to replace the ballast liquid entering the buoyancy cell 31.

Installation of a tether 10 incorporating the present buoyancy system 12 is straightforward. The lowermost tether sections 14 are completely filled with ballast liquid as they are connected and lowered from the main body of the TLP 24. This establishes a load to maintain the tether 10 in tension as it is lowered to the tether foundation 20 on the ocean floor 21. No more tether sections 14 should be flooded than is necessary to maintain the tether 10 under sufficient tension in the course of installation. This ensures that installation hook loads are no greater than necessary. As shown in FIG. 7, the uppermost of the tether sections 14 which are flooded in the installation procedure is provided with a gas injection port 100 through its external wall. A gas umbilical 102 extends from the compressor 96 on the TLP 24 to the gas injection port 100. As this tether section 14 and each subsequent tether section 14 is added in the course of tether installation, they are filled with an amount of ballast liquid equal to the volume of the central access tube 32, cascade conduits 42 and air release conduits 44 within the tether section 14. Gas is pumped at a substantially constant mass flow rate and increasing pressure as the tether 10 is lowered. The rate of air injection must be great enough to ensure that the pressure differential between the tether interior and the surrounding seawater does not become high enough to permit tether collapse; however, the air injection rate must not be so great as to expel ballast liquid from the top of the central access tube 32 and cascade conduits 42. Once the tether 10 is latched to the TLP foundation 20, the central access tube 32 and cascade conduit 42 are attached to the header tank system 68 and the gas umbilical 102 is removed. The ballast-deballast tool 82 is then lowered to the bottom of the tether 10 and gas is injected. This forces the excess ballast liquid upward through the central access tube 32. Gas injection is continued until gas is observed exiting the cascade conduits 42 into the header tank 70, at which point the tether 10 is fully pressurized and pressure balanced.

Several measures may be taken to minimize internal corrosion of the tether 10. Much potential corrosion can be avoided by excluding seawater from the interior of the tether 10. This is accomplished by maintaining the pressure within each buoyancy cell 31 at a slightly higher level than that of the surrounding seawater, as detailed previously. The ballast liquid used within the access tube 32 and lower portion of each buoyancy cell 31 to maintain the buoyancy cell 31 at the desired pressure is preferably a liquid which will not support corrosion, such as ethylene glycol. However, if water is used, it should have a low ion concentration and should include suitable corrosion inhibitors. Additionally, the gas injected into the tether 10 is preferably a relatively inert gas, such as nitrogen, rather than air. If air is used to pressurize the tether 10, an internal cathodic protection system using magnesium anodes and an inorganic zinc coating on all internal metal surfaces of the tether 10 will greatly decrease the rate of corrosion.

Illustrated in FIGS. 10 through 13 is an alternate embodiment of the present invention. In this embodiment, the cascade conduit 142 is a single tubular element within each tether section 114, concentric about the central access tube 132. The use of a single large diameter cascade conduit 142 surrounding the access tube 132 is advantageous in that the cascade conduit 142 serves as a back up to the access tube 132 in the event of damage to or failure of the access tube 132. The lower end of the cascade conduit 142 is open, defining the lowest point 162 of the cascade passage joining adjacent buoyancy cells 131. Air injection into a selected buoyancy cell 131 may be accomplished by positioning the ballast-deballast tool 82 at air passage ports 174 extending through the walls of the central access tube 132 at the central access tube pin 140. At the location of the air passage ports 174 the outer face of the central access tube 132 is flared to a diameter somewhat greater than the outer diameter of the cascade conduit 142. This ensures that air injected through the air passage ports 174 passes upward into the buoyancy cell 131 rather than into the cascade conduit 142. As in the previously described embodiment, injecting air into a buoyancy cell 131 causes any ballast liquid within the buoyancy cell 131 to be forced upward through the cascade conduit 142 and central access tube 132 to the header tank 170.

In this embodiment only the bottom several tether sections 114 can be selectively refilled with ballast fluid. These bottom tether sections 114 are provided with air release conduits 144. The remaining tether sections 114 are not provided with air release conduits. The air release conduits 144 function in the same manner as the air release conduits 44 of the previously described embodiment, allowing the gas within the buoyancy cell 131 to be removed by the ballast-deballast tool 82 and replaced by ballast liquid flowing into the buoyancy cell 131 from the central access tube 132 and cascade conduit 142. In this manner the lower sections of the tether 110 can be flooded prior to tether removal to lend stability to the tether 110 as it is raised.

The preferred embodiment of the present invention and the preferred methods of using it have been detailed above. It should be understood that the foregoing description is illustrative, and that other embodiments of the invention can be employed without departing from the full scope of the invention as set forth in the appended claims.

What is claimed is:

1. A structural member adapted for use in a body of water, comprising:

an elongate load bearing wall portion, said wall portion defining a central channel extending the length of said structural member, said central channel being isolated from said body of water by said wall portion;

a plurality of bulkheads in the interior of said wall portion, said bulkheads dividing said central channel into a series of buoyancy cells adapted to contain gas;

an access tube extending along said central channel and passing through at least some of said bulkheads, said access tube being adapted to contain a column of liquid; and, means for establishing fluid communication between the interior of at least some of said buoyancy cells and the interior of said access tube, whereby fluids may be transferred between said buoyancy cells and the interior of said access tube.

2. The structural member as set forth in claim 1, wherein said elongate wall portion extends in a substantially vertical direction, each of said buoyancy cells having an upper end and a lower end, said fluid communication establishing means including a plurality of fluid passageways, said fluid passageways having one end at the interior of said access tube and the other end at the lower end of a corresponding buoyancy cell, said fluid passageway allowing unrestricted fluid flow between said access tube and said buoyancy cell.

3. The structural member as set forth in claim 1, wherein said wall portion is tubular and is adapted to extend substantially vertically through said body of water whereby each of said buoyancy cells has an upper and a lower end, said structural member further comprising means for transferring gas from a first of said buoyancy cells to the cell above in response to introducing into said first chamber an amount of gas in excess of that amount sufficient to fill said first cell from its upper end to a preselected position proximate its lower end.

4. The structural member as set forth in claim 3, wherein said gas transferring means includes a plurality of cascade conduits, each extending through a corresponding buoyancy cell, each cascade conduit having an upper and a lower end, said cascade conduit lower end being proximate a lower end of the buoyancy cell corresponding to said fluid passageway, and said cascade conduit upper end extending into the buoyancy cell above, whereby gas is transferred through said cascade conduit from one buoyancy cell to the buoyancy cell above in response to additional gas being introduced into said one buoyancy cell once said one buoyancy cell is filled with gas from its upper end to the level of the lower end of the corresponding cascade conduit.

5. The structural member as set forth in claim 4 wherein said wall portion includes a plurality of tubular wall portion sections having upper and lower ends, said bulkheads each being secured across the upper end of a corresponding one of said wall portion sections, said access tube being formed of a plurality of separate sections, each access tube section corresponding to one of said wall portion sections and extending from the upper end of the corresponding wall portion section to the lower end of the corresponding wall portion section, said access tube sections being configured to come into end to end alignment in response to said wall portion sections being joined together.

6. The structural member as set forth in claim 3 wherein said elongate wall portion extends in a substantially vertical direction, each of said buoyancy cells having an upper and a lower end, said fluid communication establishing means including a plurality of fluid passageways, said fluid passageways each having one end at the interior of said access tube and the other end at the lower end of the corresponding buoyancy cell, and wherein said access tube is substantially unobstructed along its length and is adapted to permit passage of a tool therethrough for injecting gas into a desired one of said buoyancy cells through said fluid passageway corresponding to said buoyancy cell.

7. The structural member as set forth in claim 6 further comprising means for removing gas from a selected one of said buoyancy cells and replacing said gas with a ballast liquid.

8. A tether adapted for securing a buoyant offshore structure to the bottom of a body of water, comprising:

an elongate, tubular wall portion adapted to extend from said buoyant structure to the bottom of said body of water;

a plurality of bulkheads in the interior of said tubular wall portion, said bulkheads dividing said tubular wall portion into a series of buoyancy chambers along the length of said tubular wall portion, said chambers being adapted to contain gas, each chamber having an upper portion nearest said buoyant structure and a lower portion nearest said bottom of said body of water;

an access tube within said tubular wall portion, said access tube being substantially parallel to the longitudinal axis of said tubular wall portion and passing through at least some of said bulkheads;

a plurality of first fluid passageways, each defining a fluid communication path between the interior of said access tube and a corresponding one of said chambers; and, means for transferring gas from a first of said chambers to the chamber above in response to introducing into said first chamber an amount of gas in excess of a predetermined volume which said first chamber is adapted to contain.

9. The tether as set forth in claim 8, wherein said first fluid passageways each establish fluid communication between the interior of said access tube and the lower portion of said corresponding chamber.

10. The tether as set forth in claim 9, wherein each of said first fluid passageways is situated at substantially the same elevation within said tether as the bulkhead defining the lower boundary of the chamber to which the first fluid passageway corresponds.

11. The tether as set forth in claim 8, wherein said gas transferring means includes a plurality of second fluid passageways, each defining a fluid communication path from a corresponding one of said chambers to the chamber above.

12. The tether as set forth in claim 11, wherein each second fluid passageway defines a fluid communication path from the lower portion of the corresponding chamber to the chamber above.

13. The tether as set forth in claim 8 further including a plurality of air release passageways, each corresponding to one of said chambers, each air release passageway defining a fluid communication path from the interior of said access tube to the upper portion of the chamber corresponding to the air release passageway.

14. The tether as set forth in claim 11 further including a plurality of air release passageways, each corresponding to one of said chambers, each air release passageway defining a fluid communication path from the interior of said access tube to the upper portion of the chamber corresponding to the air release passageway.

15. The tether as set forth in claim 11, wherein the tether further comprises a plurality of tubular tether sections adapted to be connected end to end to define the tether, and wherein the access tube comprises a series of access tube sections, each tether section having mounted therein one of said access tube sections, said access tube sections having opposite ends with a box element at one of said ends and a pin element at the other of said ends, said pin and box elements being configured so that in response to connecting adjoining tether sections, the pin of one of said access tube sections enters the box of the other of said access tube sections.

16. The tether as set forth in claim 15, wherein the second fluid passageway corresponding to each chamber includes at least one conduit extending parallel to the access tube section corresponding to said chamber, said conduit having a first end in said access tube section pin and a second end in said access tube section box.

17. The tether as set forth in claim 15 wherein the second fluid passageway corresponding to each chamber includes a cascade conduit concentric with and external to said access tube section.

18. The tether as set forth in claim 17 wherein the cascade conduit associated with each chamber has a lower end and an upper end, said lower end being situated proximate the lower portion of the corresponding chamber and said upper end extending through the bulkhead at the upper portion of said corresponding chamber into the next chamber above, whereby once enough gas has been introduced into said corresponding chamber to fill said corresponding chamber downward to the level of said cascade conduit lower end, all additional gas introduced into said corresponding chamber enters said cascade conduit and rises through said cascade conduit into the next chamber above.

19. A tether assembly for a tension leg offshore platform, comprising:

a plurality of tubular tether sections adapted to be connected in end to end vertical relationship, each tether section having opposed first and second end portions, at least some of said tether sections including:

a bulkhead at said first end portion, said bulkhead serving to divide the interior of said tether section into upper and lower volumes, said bulkhead having an aperture therethrough;

an access conduit element extending through said bulkhead aperture from said tether section first end portion to said tether section second end portion, said access conduit being adapted to align with the access conduit elements of the adjacent tether sections in response to said tether sections being connected together, said access conduit elements establishing a channel extending longitudinally through said tether, said channel being unrestricted by said bulkheads;

a first fluid passageway establishing fluid communication between the interior of said access conduit element and the upper volume of said tether section; and, a second fluid passageway establishing fluid communication between the upper and the lower volumes of said tether section.

20. The tether assembly as set forth in claim 19 wherein said tether section is adapted to be oriented with said first end portion upwards, said second fluid passageway extending from a position proximate the upper surface of said bulkhead to a position proximate said second end portion.

21. The tether assembly as set forth in claim 20 wherein said access conduit element of each tether section is provided with a pin proximate said second end portion of said tether section and wherein said bulkhead of each tether section is provided with a box adapted to receive the corresponding conduit element pin in response to the tether sections being connected together, said bulkhead box defining said bulkhead aperture.

22. The tether assembly as set forth in claim 20 wherein said second fluid passageway is a cascade conduit adapted to permit the passage of gas from the second end portion of said tether section upward through the bulkhead of said tether section into the next tether section above.

23. The tether assembly as set forth in claim 22 wherein said cascade conduit includes a tube surrounding said access conduit.

24. A tether for a tension leg offshore platform, comprising:

a tubular load bearing wall portion having an upper and a lower end, said wall portion defining an enclosed volume isolated from the surrounding body of water by said wall portion, said wall portion upper end being adapted to be secured to the main body of said platform and said wall portion lower end being adapted to be secured to a foundation at the bottom of said body of water;

a plurality of bulkheads secured to said wall portion and extending laterally across said enclosed volume, said bulkheads being spaced one from the other along the length of said tubular wall portion and serving to divide said enclosed volume into a series of buoyancy cells adapted to contain gas; and an access tube extending axially through said enclosed volume, said access tube passing through said bulkheads from said wall portion upper end to a position proximate said wall portion lower end, said access tube being adapted to be filled with a liquid, said access tube being configured to define a fluid pathway corresponding to each buoyancy cell, said pathway placing the interior of said access tube in fluid communication with the buoyancy cell corresponding to said fluid pathway.

25. The tension leg platform tether as set forth in claim 24 wherein each of said fluid pathways is situated proximate the lower end of the buoyancy cell to which it corresponds whereby the internal pressure of each buoyancy cell at its lower end is substantially equal to the interal pressure of said access tube proximate the lower end of the corresponding buoyancy cell.

26. The tether as set forth in claim 24 further comprising means for transferring gas from a first of said buoyancy cells to the buoyancy cell above in response to introducing into said first buoyancy cell an amount of gas in excess of that amount sufficient to fill said first cell from its upper end to a preselected position proximate its lower end.

27. The tether as set forth in claim 26 wherein each of said buoyancy cells is provided with said gas transferring means, whereby in response to the continued injection of gas into any selected buoyancy cell, said gas will cascade upward from buoyancy cell to buoyancy cell filling with gas each buoyancy cell above said selected buoyancy cell.

28. The tether as set forth in claim 27 wherein said gas transferring means includes a cascade conduit associated with each buoyancy cell, each cascade conduit extending from a lower portion of the corresponding buoyancy cell into the buoyancy cell above.

29. A tether and buoyancy system therefor, said tether being adapted for use in securing a tension leg offshore platform to a foundation at the bottom of a body of water, said tether and associated buoyancy system comprising:

a tubular load bearing wall portion having an upper and a lower end, said wall portion defining an enclosed volume isolated from the surrounding body of water by said wall portion, said wall portion upper end being adapted to be secured to the main body of said platform and said wall portion lower end being adapted to be secured to a foundation at the bottom of said body of water;

a plurality of bulkheads secured to said wall portion and extending laterally across said enclosed volume, said bulkheads being spaced one from the other along the length of said tubular wall portion and serving to divide said enclosed volume into a series of buoyancy cells adapted to contain gas;

an access tube extending axially through said enclosed volume, said access tube passing through said bulkheads from said wall portion upper end to a position proximate said wall portion lower end, said access tube being adapted to be filled with a liquid, said access tube being configured to define a fluid pathway corresponding to each buoyancy cell, said pathway placing the interior of said access tube in fluid communication with the buoyancy cell corresponding to said fluid pathway; and a gas compressor situated on said tension leg offshore platform; and a gas conduit adapted to be at least temporarily connected between said compressor and one of said buoyancy cells, whereby gas may be injected through said gas conduit into said one buoyancy cell.

30. The tether and buoyancy system therefore as set forth in claim 29 further including means for selectively filling the lowermost buoyancy cell with liquid.

* * * * *